US007837454B2

(12) United States Patent
Toncelli

(10) Patent No.: US 7,837,454 B2
(45) Date of Patent: Nov. 23, 2010

(54) APPARATUS FOR DISTRIBUTING IN A THIN LAYER A MIX BASED ON AGGLOMERATE STONE OR CERAMIC MATERIAL

(76) Inventor: Luca Toncelli, Viale Asiago 34, 36061 Bassano del Grappa (VI) (IT)

( * ) Notice: Subject to any disclaimer, the term of this patent is extended or adjusted under 35 U.S.C. 154(b) by 600 days.

(21) Appl. No.: 11/664,326

(22) PCT Filed: Oct. 19, 2005

(86) PCT No.: PCT/EP2005/055376

§ 371 (c)(1),
(2), (4) Date: Mar. 29, 2009

(87) PCT Pub. No.: WO2006/045728

PCT Pub. Date: May 4, 2006

(65) Prior Publication Data

US 2009/0101790 A1 Apr. 23, 2009

(30) Foreign Application Priority Data

Oct. 20, 2004 (IT) ..... TV2004A0118

(51) Int. Cl.
*B28B 7/36* (2006.01)
*B28B 13/02* (2006.01)

(52) U.S. Cl. ..... 425/89; 425/150; 425/447; 222/415; 141/284

(58) Field of Classification Search ..... 425/80.1–83.1, 425/89, 141, 447, 449; 264/109–128; 222/415; 141/284
See application file for complete search history.

(56) References Cited

U.S. PATENT DOCUMENTS 1,726,511 A 8/1929 Henry et al.
3,540,093 A 11/1970 Boatright, Jr. et al.
3,663,137 A 5/1972 Haas et al.
3,954,377 A 5/1976 Scholz et al.
4,321,028 A 3/1982 Van de Caveye
4,602,771 A 7/1986 Milliron et al.
4,695,418 A 9/1987 Baker et al.
5,338,179 A 8/1994 Luca (Continued)

FOREIGN PATENT DOCUMENTS

DE 294 453 10/1991

(Continued)

OTHER PUBLICATIONS

International Search Report and Written Opinion dated Feb. 15, 2006 from the corresponding PCT/EP2005/055376.

(Continued)

*Primary Examiner*—Michael A Tolin
(74) *Attorney, Agent, or Firm*—Katten Muchin Rosenman LLP

(57) ABSTRACT

In a plant for producing thin articles in the form of a slab, manufactured with a mix (M) based on agglomerate stone or ceramic material, the mix is distributed in a thin layer on a support (90) using a distributor (100) comprising a hopper (120) and an underlying extractor belt (150). Means (132, 151) are provided for preventing interruption of the article production cycle, required to eliminate the incrustations resulting from contact of at least part of the hopper (120) and/or the extractor belt (150) with the mix.

24 Claims, 7 Drawing Sheets

U.S. PATENT DOCUMENTS

| | | | | |
|---|---|---|---|---|
| 6,074,193 | A * | 6/2000 | Kratky et al. | 425/81.1 |
| 6,086,349 | A | 7/2000 | Del Monte | |
| 6,695,605 | B1 * | 2/2004 | Wirthel et al. | 425/83.1 |
| 7,140,869 | B2 | 11/2006 | Toncelli | |
| 7,278,551 | B2 * | 10/2007 | Graf et al. | 222/77 |

FOREIGN PATENT DOCUMENTS

| | | | |
|---|---|---|---|
| EP | 1 170 104 | A | 1/2002 |
| EP | 1 419 863 | A | 5/2004 |
| ES | 2 172 418 | | 9/2002 |
| FR | 864846 | | 5/1941 |
| FR | 1591141 | | 4/1970 |
| FR | 2052704 | | 4/1971 |
| GB | 880892 | | 10/1961 |
| IT | 1273903 | | 1/1996 |
| JP | 02 116517 | A | 5/1990 |
| JP | 2001-162612 | | 6/2001 |
| WO | WO 96/15888 | A | 5/1996 |
| WO | WO03027042 | | 4/2003 |
| WO | WO A 2004 039547 | | 5/2004 |

OTHER PUBLICATIONS

United States Office Action dated Aug. 12, 2005, from the corresponding United States Application.
United States Office Action dated Feb. 17, 2006, from the corresponding United States Application.
International Search Report dated Mar. 23, 2004.
International Preliminary Examination Report dated Jan. 11, 2005.

* cited by examiner

APPARATUS FOR DISTRIBUTING IN A THIN LAYER A MIX BASED ON AGGLOMERATE STONE OR CERAMIC MATERIAL

This application is a National Phase Application of International Application No. PCT/EP2005/055376, filed Oct. 19, 2005, which claims the benefit under 35 U.S.C. 119(a-e) of Italian Application No. TV2004A000118, filed Oct. 20, 2004, which is herein incorporated by reference.

FIELD OF THE INVENTION

The present invention relates to an apparatus for distributing, in a thin layer on a support, a mix based on agglomerate stone or ceramic material.

BACKGROUND ART

It is well known to produce flat articles in particular slabs using mixes obtained by mixing stone or ceramic granules with binders. The starting stone materials may be natural hard stone and the binders may be organic, chosen from among synthetic resins, or inorganic, for example of the cement based type. The production envisages the use of supports slightly bigger than the slabs, which may have large dimensions, for example 3.20×1.60 m, and very small thicknesses, for example 8 mm. After distribution of the mix in a thin layer, the article firstly undergoes a vibrocompaction step, namely pressing and simultaneous vibration, in a vacuum environment, and then a hardening step, which requires a heat supply when the binder is organic. Therefore taking into account:

- the numerous compositions of the mixes considered here;
- the fact that the mixes are sticky and have a consistency very similar to that of wet sand and therefore markedly different from the consistency of a concrete;
- the articles produced with the mixes are intended for use either in the building sector, as flooring and cladding for internal or external walls of residential buildings, or in the furnishing sector, as work-tops for kitchens or bathrooms;
- it is often required to use liquid or powdery colouring substances in order to improve the aesthetic features of the articles;

the various parts of the plant used to manufacture the said articles must ensure a high level of quality without wastage of material and/or unjustifiable costs. In particular these requirements must be satisfied by the apparatus used commonly called a mix distributor and by the devices for dispensing the colouring substances. A recent example of a mix distributor is described in the patent application WO-A-2004/039547 in the name of the present Applicant and comprises a carriage movable on the top of a tray mould and having a hopper arranged above. The bottom of the hopper is formed by a conveyor called an extractor belt which is inclined downwards and which passes underneath an opening provided at the bottom of a wall of the hopper which on its inner side has a particular shape and extends beyond said wall. A quantity of mix slightly greater than that required for production of a slab is loaded via an upper mouth into the hopper and gradually discharged through said opening so as to be finally deposited inside the mould while the carriage moves above the latter. The object of said inner shape is to favour the dimensional uniformity and agglomeration of the mix deposited inside the mould owing to the fact that the flow of mix inside the hopper is obliged to pass from an initial vertical direction to a direction parallel to the inclination of the extractor belt, extending from the discharge opening at the bottom of the hopper.

Even though this distributor as a whole is to be considered satisfactory, it requires frequent maintenance operations when (as is usually the case) the plant of which the distributor forms part is used for the mass production of articles. Owing in particular to the already mentioned stickiness, the mix has in fact the tendency to line the extractor belt and form on the abovementioned shaped wall and on the discharge opening of the hopper incrustations which, altering the cross-sectional dimensions of the mix layer discharged onto the extractor belt, could give rise to a non-uniform distribution of the mix. It is therefore necessary to interrupt immediately operation of the distributor as soon as an irregularity in discharging of the mix is noticed, in order to eliminate the incrustations, but obviously these interruptions reduce the productivity of the plant of which the distributor forms part.

As regards the addition of colouring substances to the mixes, from among the most valued and popular aesthetic features of the articles, it is important to mention the so-called veined effect which imitates the appearance of natural stone material.

A first patent in this connection is IT-A-1 273 903, filed on 22 Jul. 1994 in the name of the present Applicant, in which it is envisaged that, before the mix is deposited in a mould, a liquid or powdery colouring substance is added onto its surface and distributed in a discontinuous manner. However, this procedure, not performed in conjunction with the distributor according to the present invention, is unable to ensure over the whole finished product that particular irregular and localized distribution of the said colouring agent which is needed to create a proper veined effect.

The patent application WO-A-03 027 042 describes an alternative method which is able to achieve the desired irregular and localized distribution of the said colouring agent and therefore the veined effect, directly on the support with which a slab is produced, before the vacuum vibrocompaction step is performed. This method has the drawback, however, that the veined effect remains localized on the surface layer instead of being present throughout the thickness of the slab. Therefore, when the slab undergoes polishing of the edges or deep machining before being used, the veined effect is no longer apparent, as would be desirable.

Also worth mentioning is EP-A-1 170 104 disclosing a distributor of powdered products to decorate ceramic tiles comprising a conveyor belt provided with hollow means which is open outwardly to contain parts of the powdered products.

OBJECT AND SUMMARY OF THE INVENTION

The main object of the invention is therefore to provide an apparatus which comprises and incorporates in an optimum manner an agglomerate mix distributor of the type mentioned and the devices for adding to the mixes colouring substances in order to obtain the veined effect and/or other aesthetic effects.

This object, together with others, is achieved with a plant which has the characteristic features of the following claims.

BRIEF DESCRIPTION OF THE DRAWINGS

These and other characteristic features of the present invention and the consequent advantages will become clear from the following detailed description of a preferred but not exclusive embodiment of the invention, with reference to the accompanying drawing, in which.

DESCRIPTION OF AN EMBODIMENT OF THE INVENTION

Figure 1:
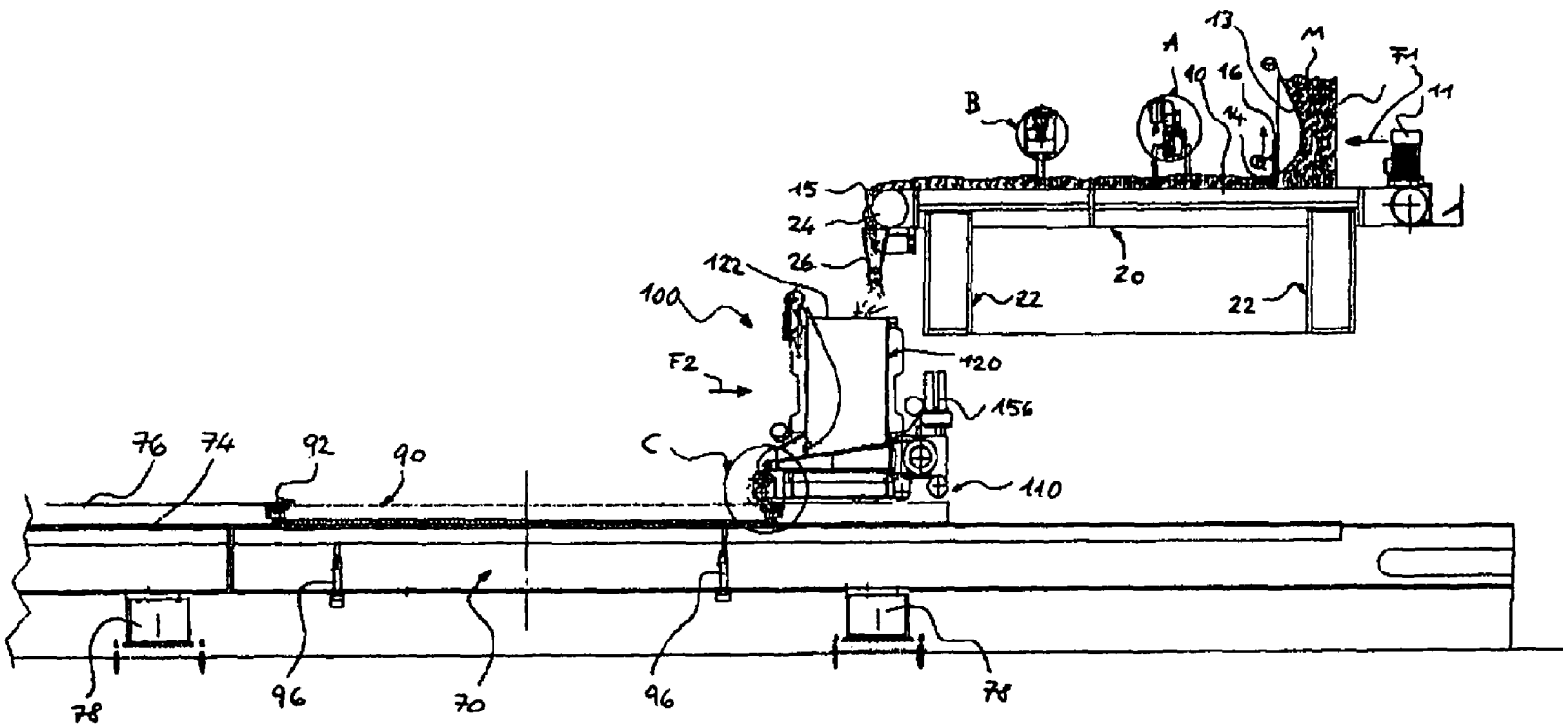
FIG. 1 is a schematic longitudinal view, not to scale, of an apparatus according to the present invention, forming part of a slab production plant.

An apparatus according to the invention, having the function of depositing a thin, uniform and adequately coloured layer of mix onto a support, comprises the following parts, shown without many details in FIG. 1:

- a belt 10 feeding the mix M from a mixer (not shown) where it is prepared using granules of stone or ceramic material and organic or inorganic binders;
- a group 30 of devices for dispensing liquid colouring substances onto the mix M moving on the feeder belt 10 (in FIG. 1 the group 30 is indicated by circle A);
- a device 50 (indicated by circle B in FIG. 1) for dispensing a powdery colouring substance onto the mix M moving on the feeder belt 10;
- a movable mix distributor 100.

If we now describe more precisely the various parts of the apparatus, the horizontal feeder belt 10, which is actuated by a motor 11 in the direction of the arrow F1, receives the mix M from a mixer (not shown, where it is produced using the materials indicated above) by means of a fixed hopper 12, of which it forms the bottom. Underneath the shaped front wall 13 of the fixed hopper 12 there is a bottom opening 14 provided with a gate 16 which allows regulation of the flow-rate, interrupting it during operation of the distributor 100. The constructional features of the fixed hopper 12 are the same as those of the movable hopper 120 forming part of the mix distributor 100. The corresponding description is therefore provided further below. The actual capacity of the fixed hopper 12 is such as to contain a quantity of mix greater than the maximum quantity of mix to be distributed on the support. A fixed framework, of which in FIG. 1 only the upper parts 20 and 22 are shown, supports the belt 10 in a raised position with respect to the distributor 100.

Underneath the front end 15 of the belt 10, where the drum 24 is situated, there is a funnel 26 having the function of conveying into the distributor 100 the mix M falling from the belt 10 which, as already mentioned, moves in the direction of the arrow F1 shown in FIG. 1.

Between the fixed hopper 12 and the front end 15 of the belt 10 there is arranged in succession, above the said belt, a group 30 of devices for dispensing liquid colouring substances (indicated by the circle A in FIG. 1) and a device 50 (indicated by the circle B in the same FIG. 1) for dispensing a powdery colouring substance onto the mix M moving on the belt 10.

Figure 2:
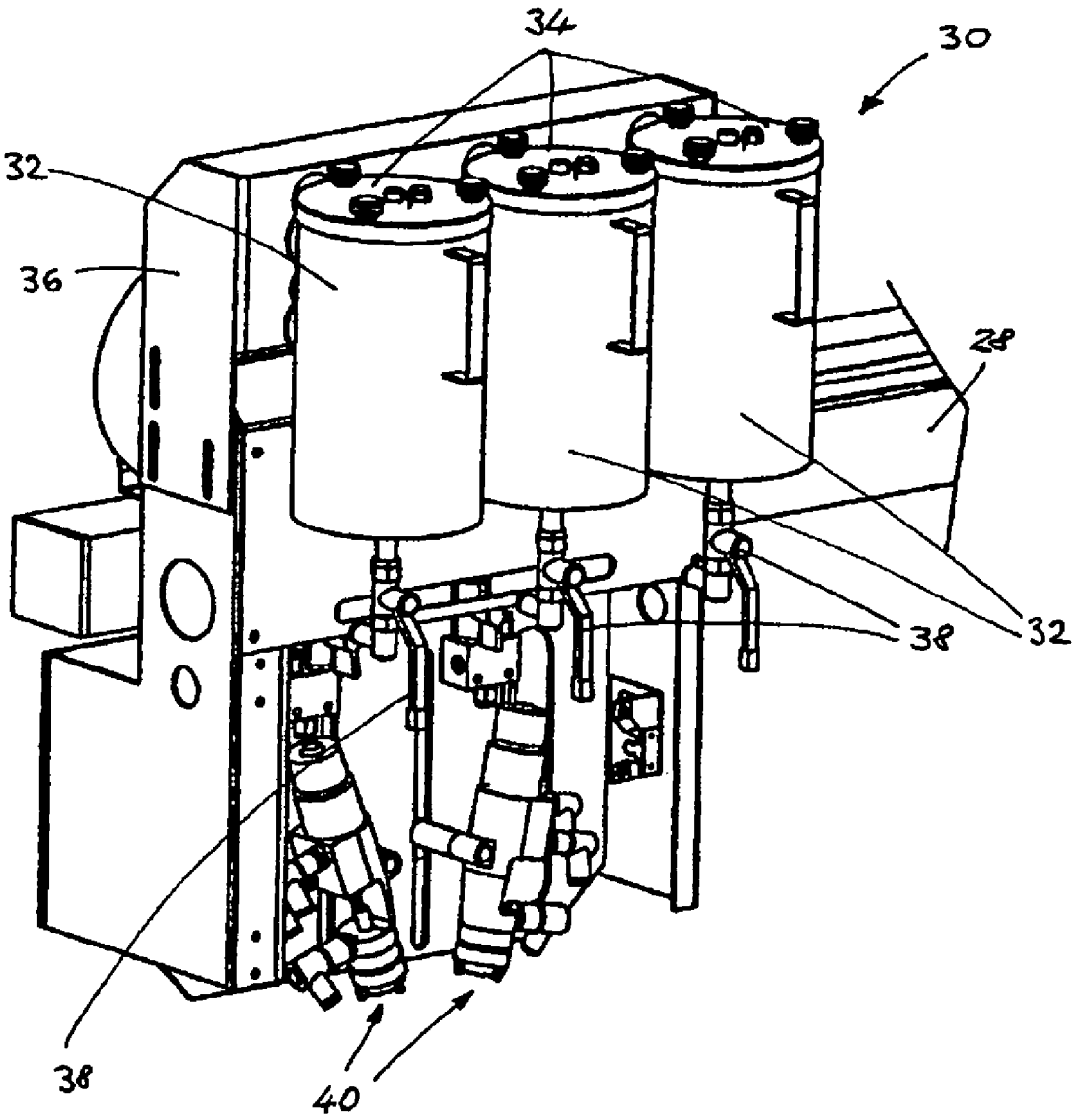
FIG. 2 is a three-dimensional view, on a larger scale, of the set of devices indicated by the circle A in FIG. 1, for dispensing liquid colouring substances.

As shown in FIG. 2, the group 30 comprises a plurality of small cylindrical tanks 32 arranged vertically and provided with respective lids 34 so that they may be filled with different liquid colouring substances. The tanks 32, from the lids 34 of which well known vane mixers (not shown) may be hung internally, are suspended from a common box-like structure 36 which is in turn supported by a beam 28 of the already mentioned fixed framework. The box-like structure 36 encloses a corresponding number of known actuating and control devices (also not shown) including power supply devices for any electric motors associated with the vane mixers. Respective tubular connections 33 extend from suitable openings on the bottom ends of the tanks 32 and are provided with manual shut-off valves 38 which are connected by means of flexible pipes (not shown for the sake of greater clarity) to respective dispensing devices 40 in which both the direction and the flow-rate of the jets may be regulated manually in a manner well-known per se. It is clear that, since it is possible to use different pigments as well as adjust the direction and the flow-rate of the jets of the various colouring substances, the varieties of veined effect which can be obtained are practically unlimited.

Figure 3:
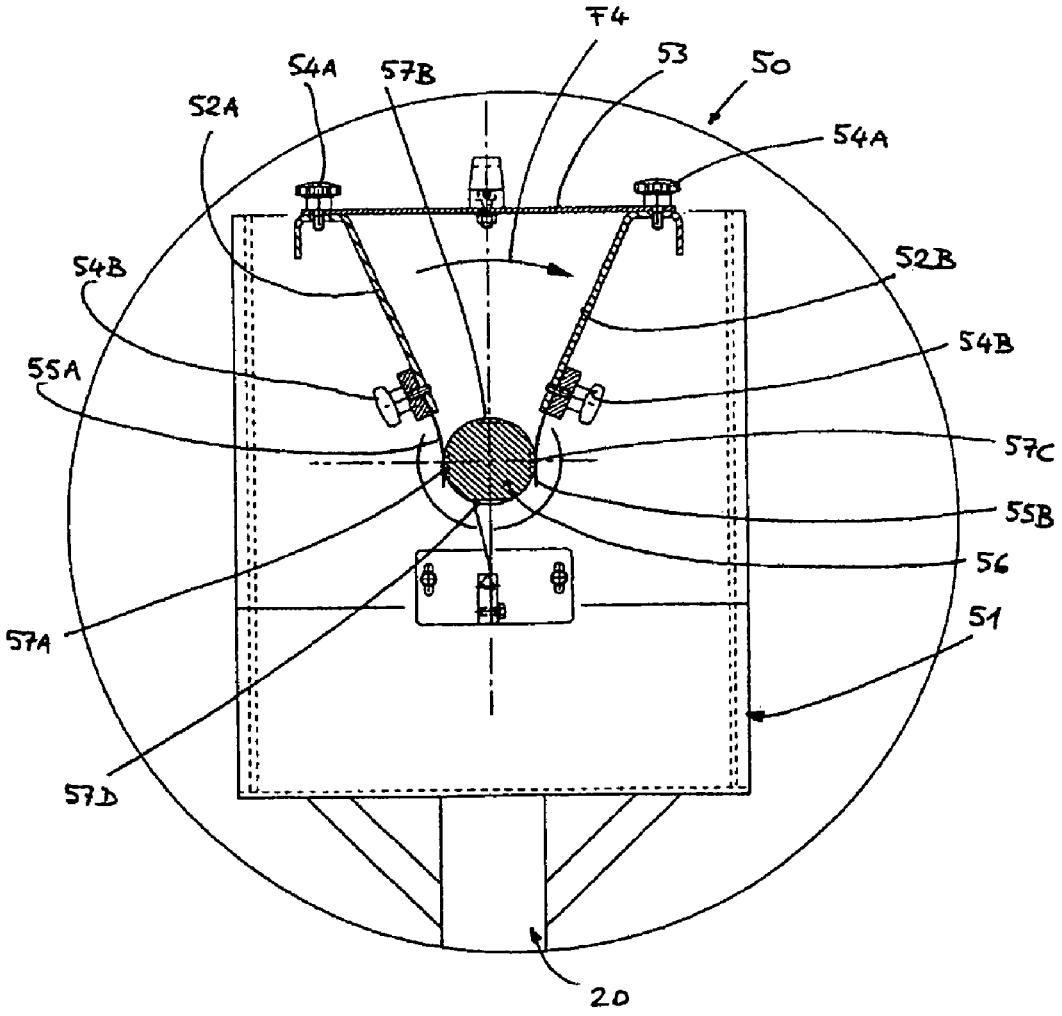
FIG. 3 is a cross-sectional view, on a larger scale, of the device indicated by the circle B in FIG. 1, for dispensing powdery colouring substances.

If we now consider the device 50 for dispensing a powdery colouring substance onto the mix M (see FIG. 3), it is substantially of the type described in the patent IT-A-1 273 903. It comprises a support structure 51 which is fixed to the abovementioned framework and which supports two inclined walls 52A, 52B converging downwards so as to define a prismatic funnel which is closed at the top by a lid 53 fixed by means of threaded pommels 54A to the walls 52A, 52B. Respective flexible metallic plates 55A, 55B are fixed at the bottom of the said walls by means of other threaded pommels 54B, said plates being kept in contact with a metering cylinder 56 which forms the bottom of said funnel and is actuated in the direction of the arrow F4 by a motor (not shown). The axis of the metering cylinder 56 is perpendicular to the direction F1 of feeding of the freshly made mix M on the belt 10 and is located at a certain distance above it. Four helical grooves 57A-D, which are coaxial with the said cylinder and offset at 90 degrees with respect to each other, are formed on the surface of the metering cylinder 56. The powdery colouring substances are loaded inside the funnel and also fill the groove or these grooves (the groove 57B in the position shown in FIG. 3) which are directed upwards. The gradual rotation of the metering cylinder 56 in the direction of the arrow F4 moves this groove (or grooves) downwards so that the colouring substances loaded into it (or them) fall by means of gravity onto the underlying mix conveyed by the belt 10 while, in the meantime, other grooves are filled with the colouring substances present between the walls 52A, 52B.

Figure 5:
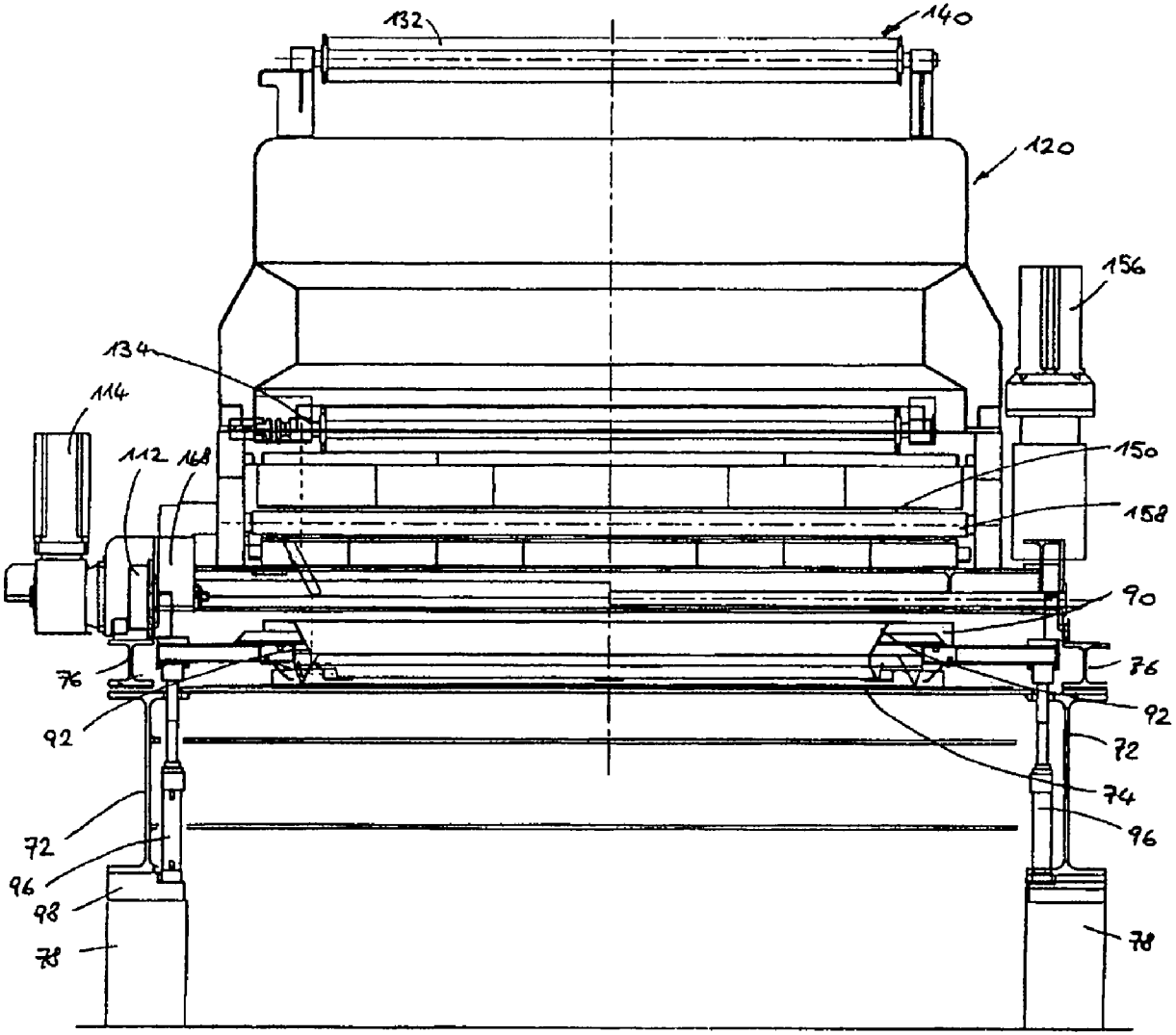
FIG. 5 shows, viewed from the front, the mix distributor according to FIG. 4 and an underlying mould, partially sectioned.
Figure 6:
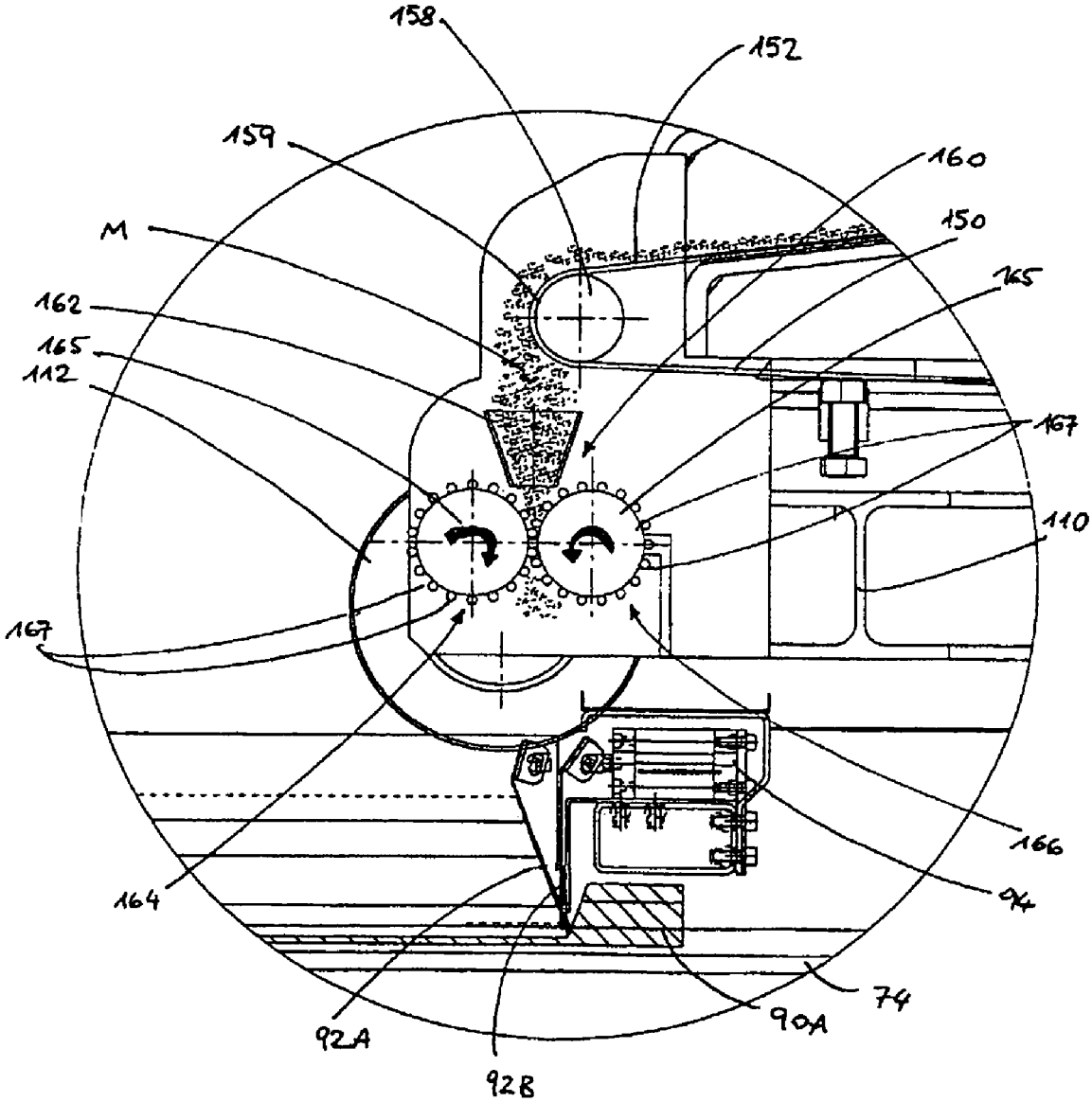
FIG. 6 is a cross-sectional view, on larger scale, of a lump-breaking device indicated by the circle C in FIG. 1.

Before describing the mix distributor 100 it is pointed out that it is associated with a line for production of the abovementioned articles which normally comprises a fixed framework 70 which is secured to the floor by means of uprights 78 and along which a horizontal conveyor belt 74 for moving the support 90 travels, said belt being able to receive the mix which is deposited thereon. Before the mix is deposited, a horizontal rectangular surrounding frame 92 is placed on the perimeter of the support 90 (which may be, for example, a tray-shaped mould of the type described in patent application EP-A-1 160 064 in the name of the present Applicant), said surrounding frame corresponding to the shape and the size of the slab to be manufactured and having the function of assisting and containing the mix M which is distributed on the support. The four sides of the surrounding frame 92 consist of metal sections with a height greater than that of the layer of mix to be distributed and connected to respective actuators 96 which are mounted vertically on stationary supports 98 so as to be not only raised and lowered (see FIGS. 5 and 7). The said sides 92 of the surrounding frame are also able to pivot about respective horizontal axes, as will be explained more clearly below, since they are hinged at the top with other respective pneumatic cylinders 94 which are mounted horizontally. FIG. 6 shows one of the sides with the reference number 92A when it is arranged in an oblique position and with the reference number 92B when it is in the vertical position.

The mix distributor 100 (which is shown in FIG. 1 in the position assumed during loading with the mix M supplied by the feeder belt 10 and at the end of distribution of the said mix on the support 90) comprises three main parts, namely:

- a carriage 110 which is actuated by a variable-speed motor and equipped with wheels 112 coupled to respective rails 76 fixed above the longitudinal walls 72 of the fixed framework 70 as well as load sensors 116 (see also FIG. 7) suitably connected to a process controller housed inside the command console (not shown) of the entire apparatus;
- a hopper 120 which is fixed to the carriage 110 and therefore movable and is filled via the upper mouth 122 with a predetermined amount of mix falling from the belt 10 through the funnel 24;
- an extractor belt 150 which is integral with the carriage 110 and actuated by an electric motor 156; the upper side 152 of the extractor belt 150 which is inclined forwards by about 10° with respect to the horizontal, forms the bottom of the hopper 120.

Figure 4:
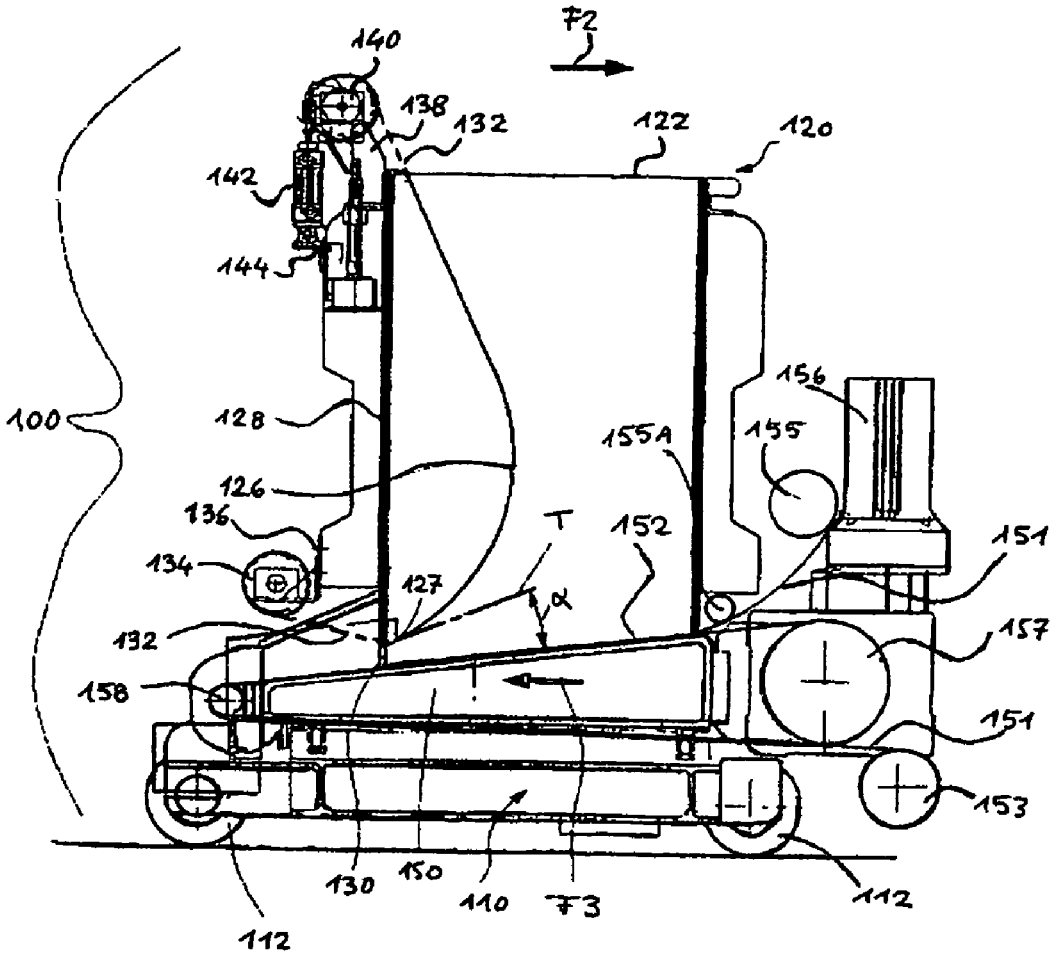
FIG. 4 is a cross-sectional view, on a larger scale, of the mix distributor of the apparatus shown in FIG. 1.

In FIGS. 1 and 4 the arrow F2 indicates the direction of the carriage 110 and therefore the entire distributor 100 during deposition of the mix M onto the support 90, while in FIG. 4 the arrow F3 indicates the simultaneous direction of feeding of the extractor belt 150 opposite to F2.

Figure 7:
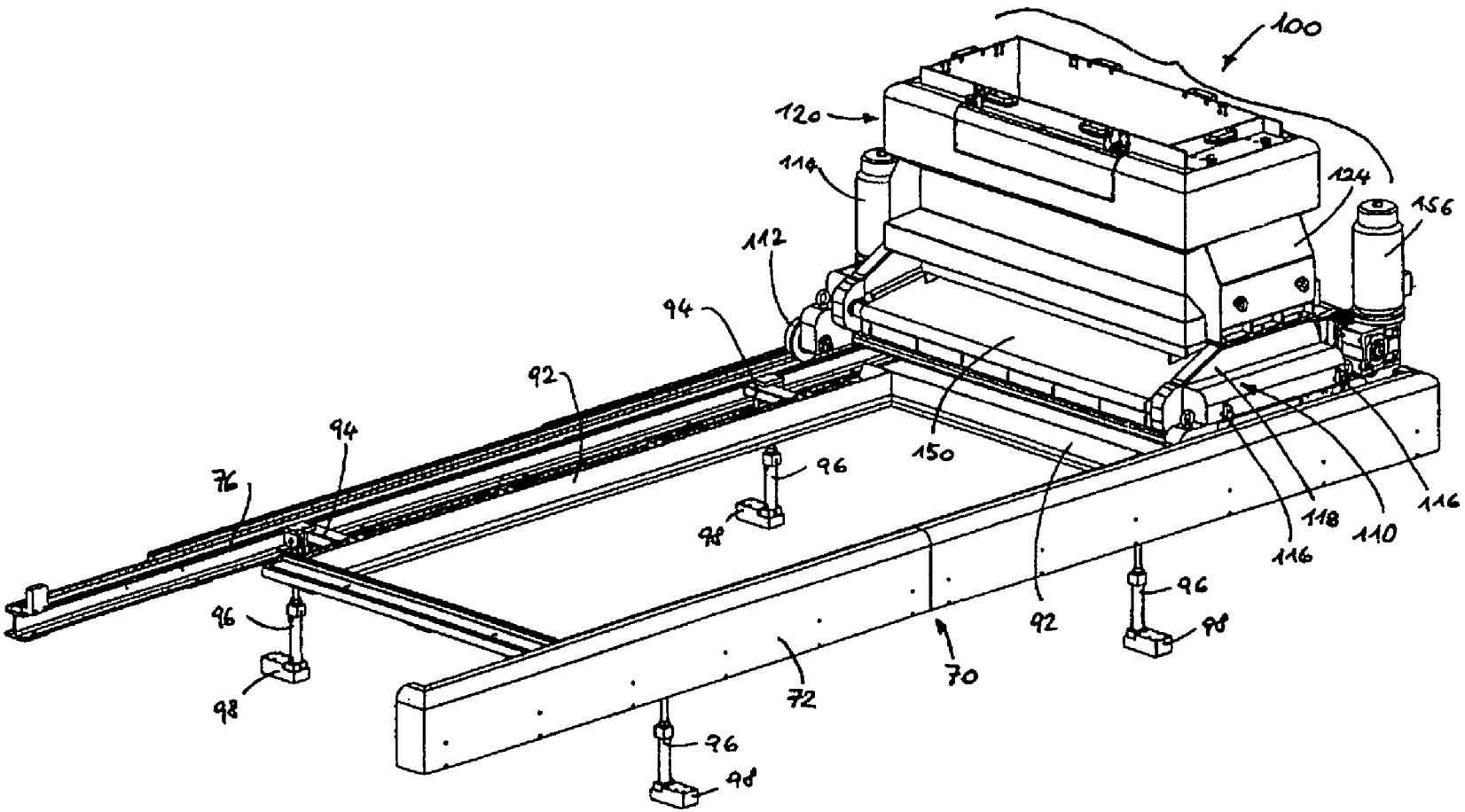
FIG. 7 shows a three-dimensional view of the distributor (for greater clarity not complete with all the details shown in FIGS. 4 and 5) on top of the framework along which it moves.

The hopper 120 (which constitutes an improvement to the hopper described in the already discussed patent application WO-A-2004/039547 and which, as already mentioned, is constructionally identical to the fixed hopper 12) is shown in detail in FIG. 4 and comprises a parallelepiped outer structure fixed along the smaller sides 124 to the corresponding edges 118 of the carriage 110 (see also FIG. 7). Said outer structure is provided with a rectangular opening 130 for discharging the mix at the bottom of the larger side 128, which is called here "rear side" in that it is located on the opposite side to the direction of the arrow F2. In addition to said outer structure, of which the rear side 128 forms part in particular, the hopper 120 comprises an internal structure, the characterizing element of which is the shaped rear wall 126 which is referred to from here on as "guide". The guide 126 has a profile with a variable geometrical form curved inwards and terminates at the bottom, according to a characteristic feature of the invention, in a sharp edge 127 which forms the upper edge 131 of the discharge opening 130. In FIG. 4 the dot-dash line T indicates the plane tangential to the profile of the wall 126 at the edge 127 and the angle $\alpha$ is the angle formed by said plane with the inclined plane defined by the inclined upper side 152 of the extractor belt 150. According to another characteristic feature of the invention, the amplitude of the angle $\alpha$ is between 10 and 20° and is preferably about 15°. According to a further fundamental characteristic feature of the invention, the guide 126 of the hopper 120 is lined with a film 132 made of anti-adhesion material (for example PTFE—polyethylene terephthalate) at least on its surface directed towards the inside of the hopper. The film 132 is fed from a reel 134 supported by means of a support 136 projecting from the outer rear side 128 of the hopper 120 at a level slightly higher than said upper edge 131 of the discharge opening 130. In this way, the section of film situated between the supply reel 134 and the sharp edge 127 of the guide 126 is inclined upwards in the direction of the said supply reel 134. The said rear side 128 also has, fixed thereto, the parts 138 supporting the reel 140 for winding up the film 132, which is arranged at a level higher than the loading mouth 122 of the hopper 120. The wind-up reel 140 is actuated intermittently by an actuator 142 supported by means of a bracket 144 of the hopper 120.

The extractor belt 150 is able to receive on its upper side 152 (inclined downwards in the feeding direction, identified by the arrow F3) the mix which passes out from the hopper 120 through the discharge opening 130 and deposit it on the support 90. In FIG. 4 the reference numbers 157 and 158 indicate respectively the front drive roller and the rear idle or driven roller of the extractor belt 150. In a preferred embodiment of the invention, the upper side 152 of the belt 150 is protected with a plastic film 151 (for example polyethylene) tensioned, with the aid of a 155° guide roller, between an idle feeder roller 155A and a motor-driven wind-up roller 153, which are arranged above each other in front of the hopper 120 (see FIG. 4). In this way the film 151 is unwound continuously during the advancing movement of the extractor belt 150 in the direction of the arrow F3. In order to prevent the film 151 slipping on the underlying upper side 152 of the belt 150, the surface of the latter is rough rather than smooth.

In order to optimize the distribution of the mix M, a lump-breaking device, denoted overall by the reference number 160, is inserted underneath the front end 159 of the extractor belt 150. The lump-breaking device 160 comprises in succession a prismatic funnel 162 which is arranged parallel to the rear side 128 of the outer structure of the hopper 120 and has the same length as it, and two metallic squirrel-cage rotors 164 and 166 (see FIG. 6) which are synchronous and counter-rotating and are actuated by a motor (see FIG. 5). Each of said rotors comprises a pair of end disks 165 on the circumference of which a plurality of straight bars 167, suitably spaced from each other, are fixed. The interaxial distance of the rotors 164 and 166 is such that the respective bars 167 interfere slightly with each other, with the result that, owing to their rotation in opposite directions, any lumps present in the mix M are broken up, the mix being made to fall exactly in the zone of interference of the two rotors 164 and 166.

The operating principle of the present apparatus is now described.

The initial configuration of the present apparatus is that where the hopper 120 of the distributor 100 is positioned below the fixed funnel 26 and a support 90 in the form of a rectangular tray is positioned on the conveyor belt 74, underneath the distributor 100. In this way, the rear part of the carriage 100 (i.e. the part opposite to that where the motors 114 and 156 are located) is situated beyond the side of the support 90 which can be seen on the left-hand side in FIG. 1. The actuators 96 keep the four sides of the surrounding frame inside the support 90 in the vertical position 92 B shown in FIG. 6 and at a short distance from the perimetral edges of the said support.

While keeping the motors 114 and 156 stopped, the hopper 120 of the distributor 100 is filled via the mouth 122 with fresh mix M supplied from the fixed hopper 12 and fed by means of the conveyor belt 10 in the direction of the arrow F1. The dispensing devices 40 of the group 30 and/or the device 50 cause the colouring substances to fall, in the desired combination and manner, onto the mix before it reaches the front end 15 of the belt 10 and therefore the fixed funnel 26. The quantity of mix loaded into the hopper 120 is predetermined depending on the dimensional and weight characteristics of the slab of agglomerate material to be made and is carefully controlled by means of the load sensors 116.

Once loading of the hopper 120 has finished, with consequent interruption of the flow of fresh mix M, the motor 116 of the carriage 110 is started so as to bring the distributor 100 to the opposite end of the support 90 (relative to that shown in FIG. 1). Once this position is reached, the motor 116 changes its direction of operation so as to move the carriage 110 on top of the support 90 in the direction of the arrow F2 in FIG. 1, and the motors 156 of the extractor belt 150 and 168 of the lump-breaking device 160 are started. Consequently, inside the hopper 120 there is a flow of mix which, owing to the shaped profile of the guide 126, passes from a substantially vertical direction into a direction inclined at the angle $\alpha$ with respect to the upper side 152 of the extractor belt 150. Owing to the presence of the anti-adhesion tape 132, which covers entirely the guide 126 remaining stationary, and the protective film 151 which is unwound during the advancing movement of the extractor belt, there is no physical contact between the mix and the surfaces of the guide 126 and the extractor belt 150, respectively, this constituting a fundamental characteristic feature of the present invention.

The flow of mix passes out through the discharge opening 130 of the hopper 120, moves downwards in the direction of the arrow F3, falls into the prismatic funnel 162, passes between the counter-rotating rotors 164 and 166 and finally is deposited on the support 90, inside the surrounding frame 92. The flow of mix which falls from the distributor 100 is constantly controlled by the computerized unit managing the machine via the load sensors 116. A layer of mix is thus gradually deposited on the support 90, having its geometrical dimensions determined by the prismatic funnel 162 and by the surrounding frame 92, and the weight per unit of surface area of the support 90 is controlled by means of the load sensors 116.

At the end of distribution of the mix inside the support 90, the sides of the surrounding frame are pivoted through an angle of about 20° so to bring them into the position 92A shown in FIG. 6, such that the layer of mix deposited remains compressed against its perimetral edges, which thus assume a configuration inclined towards the inside of the support 90. Spilling of the mix over the edges of the support 90 is prevented when, immediately following said compression, the surrounding frame 92 is raised and extracted from the mould after its edges have been brought back into the vertical position 92B, again by means of the actuators 96. Further spillage during subsequent movement of the support 90 to the work station where vibrocompaction is performed is also prevented.

The distributor 100 (the motors 114, 156 and 158 of which as well as the motor, not shown, which actuates the roller 153 of the plastic film 151 have in the meantime been stopped) is thus situated again in the position shown in FIG. 1, with the hopper 120 not completely emptied of mix, so that a certain quantity thereof remains deposited on the protective film 155 and the extractor belt 150. By operating the actuator 142 a length of the anti-adhesion tape 132 equivalent to a few centimetres is wound onto the reel 140.

At this point the apparatus is ready to repeat the operating cycle described above, in order to produce a new slab, with reference to a new support 90 which in the meantime has been positioned on the conveyor belt 74.

When the protective tape 132 of guide 126 has been completely used, and/or at the end of production shift, the distributor 100 is removed so that it may be washed with a suitable detergent and/or replaced with a new one. In turn, at the end of use, the protective film 151 of the extractor belt 150 is conveyed away to plastics recycling plant.

From the description given the following advantages of the apparatus according to the invention are evident:

(a) the colouring devices are combined with the mix distributor and enable aesthetic effects of any type and variety to be obtained, also along the edges and inside the article;

(b) the productivity is not adversely affected by stoppages due to the need to clean parts of the apparatus (distributor hopper and extractor belt) which are in contact for relatively long periods with the mix and when the type or colour of mix and/or its aesthetic effects are changed;

(c) the dimensional uniformity and the precise weight of the layer of mix deposited on the support are respectively ensured by the presence of the sharp edge at the end of the shaped inner wall of the distributor hopper and by the computerized control of the load sensors;

(d) both the presence of lumps and sliding in the layer of mix deposited mix are prevented before it undergoes vibrocompaction.

Although the above description refers to the embodiment which is currently preferred, it is understood that the following claims also comprise other variants and embodiments, in particular:

- protection, with anti-adhesion tape, of the shaped guide forming part of the distributor may be limited to only one section, in particular the terminal or bottom section of the shaped profile of the guide;
- it is possible to use a stepper motor instead of a pneumatic cylinder as the actuator of the reel for winding up the anti-adhesion tape;
- cleaning of the guide may be achieved also using systems other than the anti-adhesion tape, which do not adversely affect the productivity of the machine;
- other walls of the internal structure of the distributor hopper may also be cleaned using one of the abovementioned systems;
- it is possible to use a stationary distributor hopper instead of one which is fixed on a carriage and move the support during deposition of the layer of mix.

The invention claimed is:

1. A distribution apparatus for distributing a mix in stone production, the apparatus comprising:

a distributor for the mix, the distributor comprising a hopper defining an interior space for temporarily holding the mix, an extractor belt positioned below the hopper to receive the mix from the hopper and transferring the mix onto a support positioned below the extractor belt;

a controller for controlling a speed of the extractor belt together with the hopper to maintain a relative movement of the extractor belt and the hopper with respect to the support to deposit a uniformly thick layer of the mix onto the support while the extractor belt and the hopper are moving;

a first dispensing means of a first film to prevent the mix coming into physical contact with a side wall of the hopper; and a second dispensing means of a second film to prevent the mix coming into physical contact with a portion of the extractor belt.

2. A distribution apparatus for distributing a mix in stone production, the apparatus comprising:

a distributor for the mix, the distributor comprising a hopper defining an interior space for temporarily holding the mix, the hopper being open at an upper end for loading the mix and being open at a lower discharge end for depositing the mix onto an extractor belt, and a guide wall disposed in the interior space of the hopper, the guide wall comprising a curved profile narrowing the interior space of the hopper;

the extractor belt positioned below the hopper to receive the mix from the hopper and transferring the mix onto a support positioned below the extractor belt;

a controller for controlling a speed of the extractor belt together with the hopper to maintain a relative movement of the extractor belt and the hopper with respect to the support to deposit a uniformly thick layer of the mix onto the support while extractor belt and the hopper are moving;

a first dispensing means of a first film to prevent the mix coming into physical contact with a portion of the guide wall; and a second dispensing means of a second film to prevent the mix coming into physical contact with a portion of the extractor belt.

3. The apparatus of claim 2, wherein the first film comprises an anti-adhesion tape, the first film covering the portion of the guide wall closest to the lower discharge end.

4. The apparatus of claim 2 further comprising an actuator for actuating the first means, the first dispensing means comprising a supply reel and a wind-up reel, each of the reels being affixed to an external side of the hopper and being actuated by the actuator to dispense the first film.

5. The apparatus of claim 4, wherein the supply reel is disposed proximate to the lower discharge end and the wind-up reel is disposed at the upper end, wherein responsive to the actuator the first film is moved from the lower discharge end to the upper end.

6. The apparatus of claim 4, wherein the actuator comprises a pulley integral with the wind-up reel and an associated alternating thrusting mechanism.

7. The apparatus of claim 6, wherein the alternating thrusting mechanism comprises a pneumatic cylinder.

8. The apparatus of claim 4, wherein the actuator comprises a stepper motor for driving the wind-up reel.

9. The apparatus of claim 2, wherein the guide wall comprises a sharp edge, the sharp edge forming an upper edge of the lower discharge end of the hopper.

10. The apparatus of claim 9, wherein a plane tangential to the profile of the guide wall at the sharp edge forms an intersection angle ($\alpha$) with an upper surface of the extractor belt, the intersection angle being between 10 and 20 degrees.

11. The apparatus of claim 2, wherein the second dispensing means comprises a motor-driven wind-up reel and an idle supply reel, wherein the second film is unwound when the extractor belt is operative.

12. The apparatus of claim 2, wherein the second film is a protective plastic film.

13. The apparatus of claim 2, wherein an upper surface of the extractor belt is roughened to prevent slippage of the second film relative to the upper surface.

14. The apparatus of claim 2 further comprising a lump-breaking device to break up immediately prior to deposition of the mix on the support clods or lumps formed in the mix.

15. The apparatus of claim 14, wherein the lump-breaking device comprises at least two counter-rotating synchronous rollers which are actuated by a motor.

16. The apparatus of claim 15, wherein each of said rotors comprises a pair of end disks on the circumference of which a plurality of straight bars spaced from each other are fixed by their end, and in that the interaxial distance of said rotors is such as to create a slight interference so that, as a result of their rotation in opposite directions, any clods or lumps present in the mix are broken up, said mix being made to fall exactly in said zone of interference.

17. The apparatus of claim 2 further comprising a feedback weighing means having a at least one load sensor connected to a control means to adjust an amount of mix loaded in the hopper or a speed of the extractor belt to ensure a uniform weight flow of mix deposited on the support.

18. The apparatus of claim 2 further comprising a carriage disposed above the support and being movable relative to the support, the hopper being affixed to the carriage and being moved by the carriage during distribution of the mix.

19. The apparatus of claim 2 further comprising a frame having dimensions in plan view slightly smaller than those of the stone article to be produced, the frame remaining inside the support during deposition of the mix.

20. The apparatus of claim 19, wherein the frame comprises a plurality of sides, each side comprising a section connected to a frame actuating means to incline the section towards an inside of the support before the frame is raised and removed from the support.

21. The apparatus of claim 2 further comprising a third dispensing means for dispensing liquid or powdery substances onto the mix before it is loaded into said hopper.

22. The apparatus of claim 21, wherein the third dispensing means comprises a plurality of sprayers having jets adjustable in a spray direction and flow rate.

23. The apparatus of claim 21 further comprising a pair of walls and a pair of flexible plates, each plate affixed to a respective wall, the walls being inclined and converging downwards and which together with the flexible plates define a prismatic funnel, a bottom of the funnel being formed by a rotating metering cylinder of powdery coloring substances, against the surface of which said flexible plates are kept in contact, said metering cylinder having an axis which is horizontal and perpendicular to the direction of feeding of the mix towards said mix distributor and being situated at a certain distance above the mix.

24. The apparatus of claim 23, wherein a surface of said rotating cylinder has, formed therein, four helical grooves which are coaxial with the said cylinder and offset with respect to each other and which are able to be gradually directed towards said prismatic drum so as to be filled with the powdery coloring substances loaded therein and then be emptied as a result of the said coloring substance falling by means of gravity onto the underlying mix.

* * * * *